US012378962B1

(12) United States Patent
Picouet et al.

(10) Patent No.: US 12,378,962 B1
(45) Date of Patent: Aug. 5, 2025

(54) SELF-POSITIONING VOLUME SLIDE CONTROL FOR SCREW COMPRESSOR

(71) Applicant: Copeland Industrial LP, St. Louis, MO (US)

(72) Inventors: Jean-Louis Picouet, Waukesha, WI (US); Steven Fels, West Allis, WI (US); Abhijit Pande, Pune (IN); Pallavi Narkhede, Pune (IN)

(73) Assignee: Copeland Industrial LP

( * ) Notice: Subject to any disclaimer, the term of this patent is extended or adjusted under 35 U.S.C. 154(b) by 0 days.

(21) Appl. No.: 18/675,800

(22) Filed: May 28, 2024

(51) Int. Cl.
*F04C 18/16* (2006.01)
*F04C 18/52* (2006.01)
*F04C 28/12* (2006.01)

(52) U.S. Cl.
CPC ..... *F04C 18/16* (2013.01); *F04C 18/52* (2013.01); *F04C 28/12* (2013.01)

(58) Field of Classification Search
CPC ..... F04C 18/16; F04C 18/52; F04C 28/12
See application file for complete search history.

(56) References Cited

U.S. PATENT DOCUMENTS 774,551 A 11/1904 Beaumont
3,088,659 A 5/1963 Nilsson et al.
3,108,740 A 10/1963 Schibbye
3,151,806 A 10/1964 Whitfield
3,314,597 A 4/1967 Schibbye
3,756,753 A 9/1973 Persson et al.
3,810,715 A 5/1974 Week et al.
3,936,239 A 2/1976 Shaw
RE29,283 E 6/1977 Shaw
4,220,197 A 9/1980 Schaefer
4,261,691 A 4/1981 Zimmern et al.
4,455,131 A 6/1984 Werner-Larson
4,478,054 A 10/1984 Shaw
4,583,373 A 4/1986 Shaw
4,597,726 A 7/1986 Soderlund
4,610,612 A 9/1986 Kocher
4,610,613 A 9/1986 Szymaszek
4,611,976 A 9/1986 Schibbye et al.
4,704,069 A 11/1987 Kocher et al.
4,842,501 A 6/1989 Schibbye
(Continued)

FOREIGN PATENT DOCUMENTS

JP 57195889 12/1982
WO 2006085866 8/2006

*Primary Examiner* — Mary A Davis
(74) *Attorney, Agent, or Firm* — Amundsen Davis, LLC

(57) ABSTRACT

Slide valve assemblies are provided that have volume slide valve members that are self-positioning, as well as compressors that include such slide-valve assemblies. The self-positioning volume slide valve member automatically slidably adjusts to control compressor volume ratio and power input to the compressor during operation of the compressor. A volume slide valve balance piston is connected to discharge gasses of the compressor and by a valve to suction gasses of the compressor. The volume slide valve balance piston exerts a balance piston pressure force on the volume slide valve member that is equal to a discharge pressure force when the valve is closed, and a balance piston pressure force that is the result of the combined pressure of the discharge gasses and suction gasses when the valve is open.

18 Claims, 9 Drawing Sheets

(56) References Cited

U.S. PATENT DOCUMENTS

| | | | | |
|---|---|---|---|---|
| 5,183,395 | A * | 2/1993 | Langouet | F04C 18/16 418/201.2 |
| 5,435,704 | A | 7/1995 | Sawyer | |
| 6,106,241 | A | 8/2000 | Zimmern | |
| 7,798,793 | B2 | 9/2010 | Shoulders | |
| 7,891,955 | B2 | 2/2011 | Picouet | |
| 8,202,060 | B2 | 6/2012 | Picouet | |
| 2006/0008375 | A1 | 1/2006 | Hasegawa | |
| 2008/0206075 | A1 | 8/2008 | Picouet | |
| 2010/0284848 | A1 | 11/2010 | Fujiwara et al. | |
| 2023/0027313 | A1 | 1/2023 | Picouet et al. | |

* cited by examiner

SELF-POSITIONING VOLUME SLIDE CONTROL FOR SCREW COMPRESSOR

FIELD OF THE INVENTION

The present technology relates to compressors and slide valve assemblies for compressors, and more particularly to slide valve assemblies having an self-positioning volume slide valve member, and controls for self-positioning volume slide valve members.

BACKGROUND

Compressors (e.g., rotary screw gas compressors) are used, for example, in compression systems (e.g., refrigeration systems) to compress refrigerant gas, such as "Freon", ammonia, natural gas, or the like. One type of rotary gas compressor employs a housing in which a motor-driven single main rotor having spiral grooves thereon that mesh with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction slide valve (also referred to as a "capacity slide valve") and a discharge slide valve (also referred to as a "volume slide valve"), for controlling an associated suction port and an associated discharge port, respectively. Generally, the capacity slide valves and the volume slide valves are moved independently by controllers, such as, for example, electrical or hydraulic controllers/motors. U.S. Pat. Nos. 4,610,612, 4,610,613, 4,704,069, 7,891,955, and 8,202,060, all of which are assigned to the same assignee as the present application, disclose a dual-slide valve rotary gas compressor of the kind described above. The teachings and disclosures of each of these patents are incorporated by reference in their entireties herein.

During operation of such single screw compressors, a small amount of oil is continuously supplied to the compression chambers to provide an oil seal at points where the main rotor meshes with the gate rotors and with the housing to thereby effectively seal the chambers against gas leakage during gas compression. The oil flows out through the discharge ports and is recovered and recirculated. When the compressor is shutdown and coasting to rest, excess oil can collect or settle in the compression chambers. When the compressor is restarted, the residual oil in the compression chambers, plus fresh oil entering the compression chambers, must be expelled through the discharge ports. In certain instances where the compressor is started with too much liquid in it, there is considerable pressure generated into the grooves of the screw because those grooves are attempting to compress a non-compressible fluid instead of the compressible refrigerant gas. Such a situation is generally known "liquid lock," which can cause degradation of the performances of the compressor, and sometimes results in the compressor stalling because the motor cannot turn the screw.

A compressor 10 having a dual slide assembly 12, of the type shown in U.S. Pat. No. 7,891,955, is illustrated in FIG. 1 (Prior Art). Specifically, FIG. 1 shows the mechanisms for moving the slide valves 14 and 16 are shown in FIG. 1. The assembly 12 includes rackshaft 18 which includes rack teeth 20 thereon. Pinion gear 22 engages rack teeth 20 on the side of slide rackshaft 18 which has one end rigidly secured to the end edge 24 of the slide valve member 14 of the slide valve assembly 12. Similarly, slide valve member 16 is moved using rackshaft 26. Rackshaft 26 includes rack teeth 28 thereon, and pinion gear 30 engages the rack teeth on the side of the rod which has an end rigidly secured to the end edge 32 of slide member 16. Controller mechanisms (not shown) are connected to each of the pinion gears 22 and 30 and are used to effect the slide valve movement the slide valves 14 and 16.

Each dual-purpose capacity and volume slide valve member 14, 16 is slidably positionable (between full load and part load positions) relative to the port 36 to control where low pressure uncompressed gas from gas inlet passage 38 is admitted to the compression chambers or grooves of main rotor to thereby function as a suction by-pass to control compressor capacity. Each volume slide valve member 16 is slidably positionable (between minimum and adjusted volume ratio positions) relative to the discharge/volume port 40 to control where, along the compression chambers or grooves, high pressure compressed gas is expelled from the compression chambers, through discharge/volume port 40 to a gas exhaust passage to thereby control the input power to the compressor. The slide valve members 14 and 16 are independently movable by the separate controllers (not shown) that are connected to pinion gears 22 and 30. A known control means or system is used to cause the controllers to position the slide valves 14 and 16 for compressor start-up. The control means or system operates the controllers to position and reposition the slide valve members 14 and 16, as needed, to cause the compressor to operate at a predetermined capacity and a predetermined power input.

Typical slide valve assemblies, such as the one shown in FIG. 1, use one or more controllers connected to pinion gears in combination with shafts, gears and a rackshaft to control the position of each of the capacity slide valve member 14 and the volume slide valve member 16. The controllers are programmed to position the valve members based on a number of factors, including for example, the compressor capacity (0 to 100%) and the internal pressures (suction and discharge).

FIG. 2 shows a perspective view of another example of a carriage and slide valve members of a prior art slide valve assembly 100. The slide valve assembly 100 includes a carriage 102, as well as two movable slide valve members or mechanisms, namely, a capacity slide valve member 104 and a volume slide valve member 106. The capacity slide valve member 104 is connected to a first rackshaft 110, which is driven by a controller (not shown) to move the capacity slide valve member 104 along its axis of movement to a desired position. The volume slide valve member 106 is connected to a second rackshaft 108, which is driven by a controller (not shown) to move the volume slide valve member 106 along its axis of movement to a desired position.

U.S. Pub No. 20230027313, the disclosure of which is hereby incorporated by reference, teaches a slide valve assembly that does not include a rackshaft connected to the volume slide valve member, but instead includes an self-positioning volume slide valve member that automatically slidably adjusts to control compressor volume ratio and power input to the compressor. However, it should be recognized that such adjustment is a function of time, rather than being instantaneous, at least with respect to large pressure changes in the compressor. One issue that may arise with the use of such a compressor is that when the compressor is stopped suddenly for any reason, the volume slide may stay at the offset position it was in immediately prior during operation, rather than adjusting back to an initial position. As a result, the compressor may experience over compression in the rotor grooves due to the volume slide offset position, for example during the starting procedure.

SUMMARY

Compressors and methods of operating compressors are disclosed herein, in which the compressors include a slide valve assembly that has an self-adjusting volume slide valve member.

In at least a first aspect, a compressor including a slide valve assembly is provided, the compressor having at least three phases of operation, including start-up, normal operation, and shutdown. The compressor comprises a slide valve carriage, a volume slide valve member secured to the slide valve carriage and slidably movable longitudinally with respect to the slide valve carriage, and a capacity slide valve member secured to the slide valve carriage and slidably movable longitudinally with respect to the slide valve carriage. The volume slide valve member has a first end and a second end, and the volume slide valve member is self-positioning longitudinally with respect to the slide valve carriage based on a plurality of pressure forces exerted on the slide valve member. There is a volume slide valve balance piston that abuts the first end of the volume slide valve member, the volume slide valve balance piston being connected to discharge gasses of the compressor and by a suction gas valve to suction gasses of the compressor. The suction gas valve is closed during normal operation.

In examples of such compressors, The slide valve assembly may not include a rackshaft connected to the volume slide valve member. Additionally or alternatively, the slide valve assembly may not include a controller connected to the volume slide valve member to cause movement of the volume slide valve member during normal operation of the compressor Moreover, while the suction gas valve is closed during normal operation, the suction gas valve may be open during start-up. Similarly, the suction gas valve may be open during shutdown. The volume slide valve balance piston exerts a balance piston pressure force on the first side of the volume slide valve member that is equal to a discharge pressure force when the suction gas valve is closed, and a balance piston pressure force that is the result of a combined pressure of the discharge gasses and the suction gasses when the suction gas valve is open.

In at least some examples, the compressor is a rotary gas compressor, and the compressor further comprises a helically grooved main rotor having a schematic rotor axis, and the main rotor is mounted for rotation about the schematic rotor axis.

In at least a second aspect, a method of operating a compressor having a slide valve assembly is provided. The compressor has at least three phases of operation, including start-up, normal operation, and shutdown. The slide valve assembly includes: a slide valve carriage; a volume slide valve member secured to the slide valve carriage and slidably movable longitudinally with respect to the slide valve carriage, the volume slide valve member being self-positioning along the axis of movement, and a volume slide valve balance piston that abuts the first end of the volume slide valve member, the volume slide valve balance piston being connected to discharge gasses of the compressor and by a suction gas valve to suction gasses of the compressor; and a capacity slide valve member secured to the slide valve carriage and slidably movable longitudinally with respect to the slide valve carriage, the capacity slide valve member being slidably movable by a controller to control compressor capacity. The method includes: operating the compressor in the start-up phase, wherein the suction gas valve is open; operating the compressor in the normal operation phase, wherein the suction gas valve is closed; adjusting the position of the slide valve member by self-positioning of the slide valve member in response to unbalanced forces during the normal operation phase; and operating the compressor in the normal operation phase under balanced conditions where there are balanced forces acting upon the volume slide member.

The method may further include operating the compressor in the shutdown phase, wherein the suction gas valve is open.

The unbalanced forces acting upon the volume slide member may include a difference between a discharge pressure and a groove pressure. In such instances, self-positioning of the slide valve member may include the slide valve member adjusting its position until the groove pressure equals the discharge pressure.

BRIEF DESCRIPTION OF THE DRAWINGS

Specific examples have been chosen for purposes of illustration and description, and are shown in the accompanying drawings, forming a part of the specification.

DETAILED DESCRIPTION

Slide valve assemblies of the present technology are generally intended for use in a variety of compressors. One exemplary compressor is a single rotary screw gas compressor adapted for use in a compression system (e.g., a refrigeration system), or the like.

Figure 1:
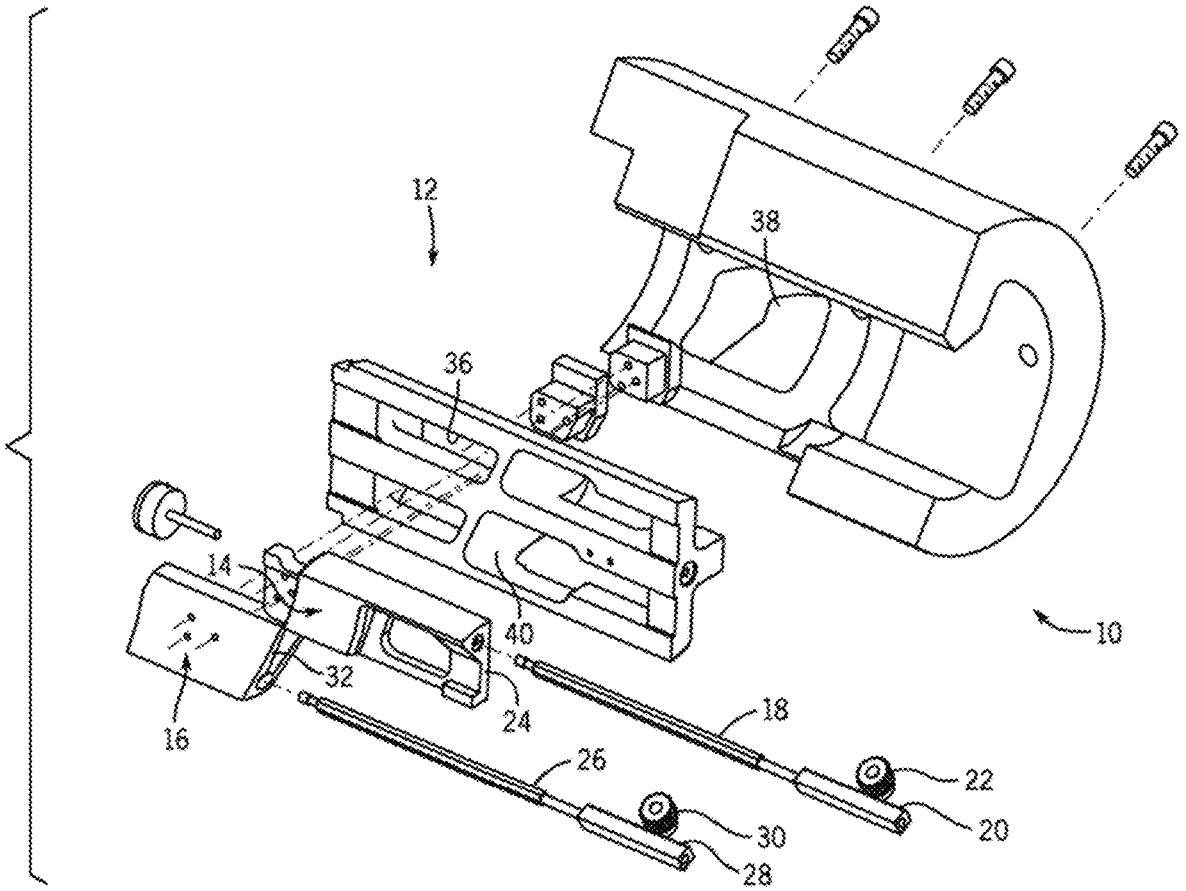
FIGURE 1 (PRIOR ART)
FIG. 1 in an exploded view of one example prior art slide valve assembly showing the mechanisms for moving the slide valves.
Figure 2:
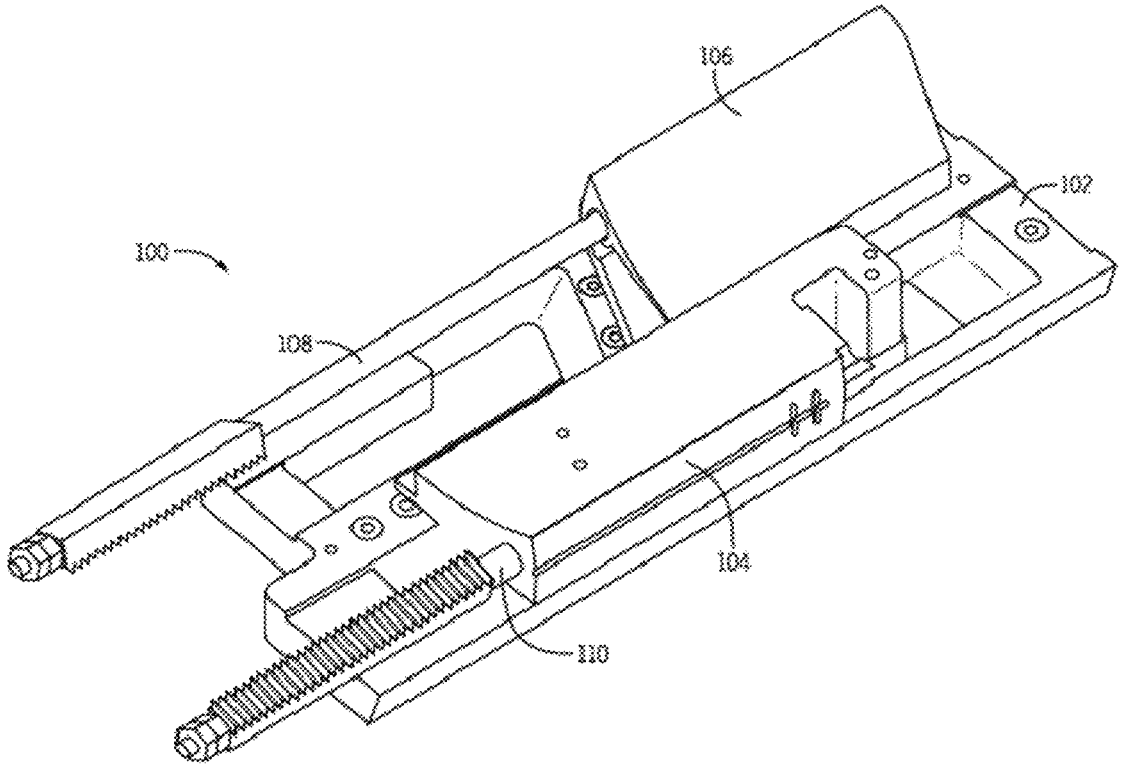
FIGURE 2 (PRIOR ART)
FIG. 2 is a top perspective view of one example of a carriage and slide valve members of a prior art slide valve assembly.
Figure 3:
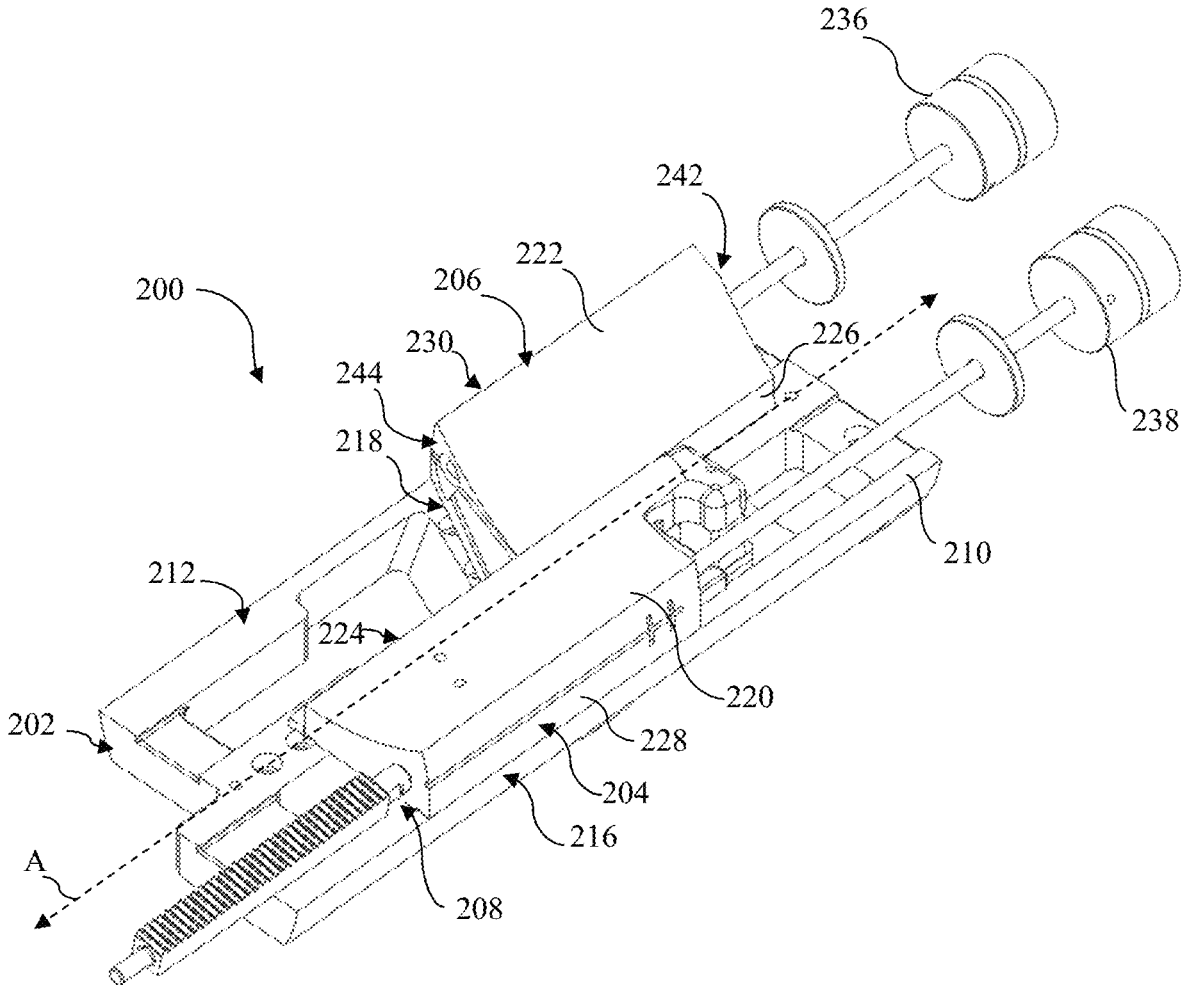
FIG. 3 is a top perspective view of one example of a carriage and slide valve members of a slide valve assembly of the present technology.
Figure 4:
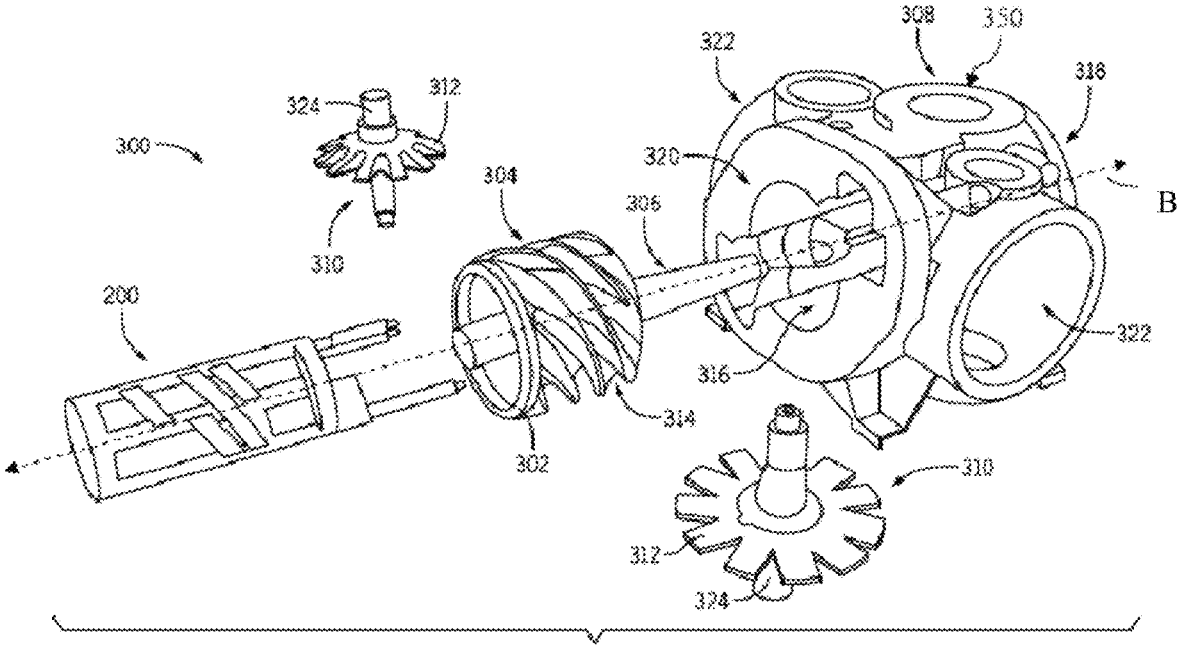
FIG. 4 is an exploded view of a single screw compressor including the slide valve assembly of FIG. 3.
Figure 5:
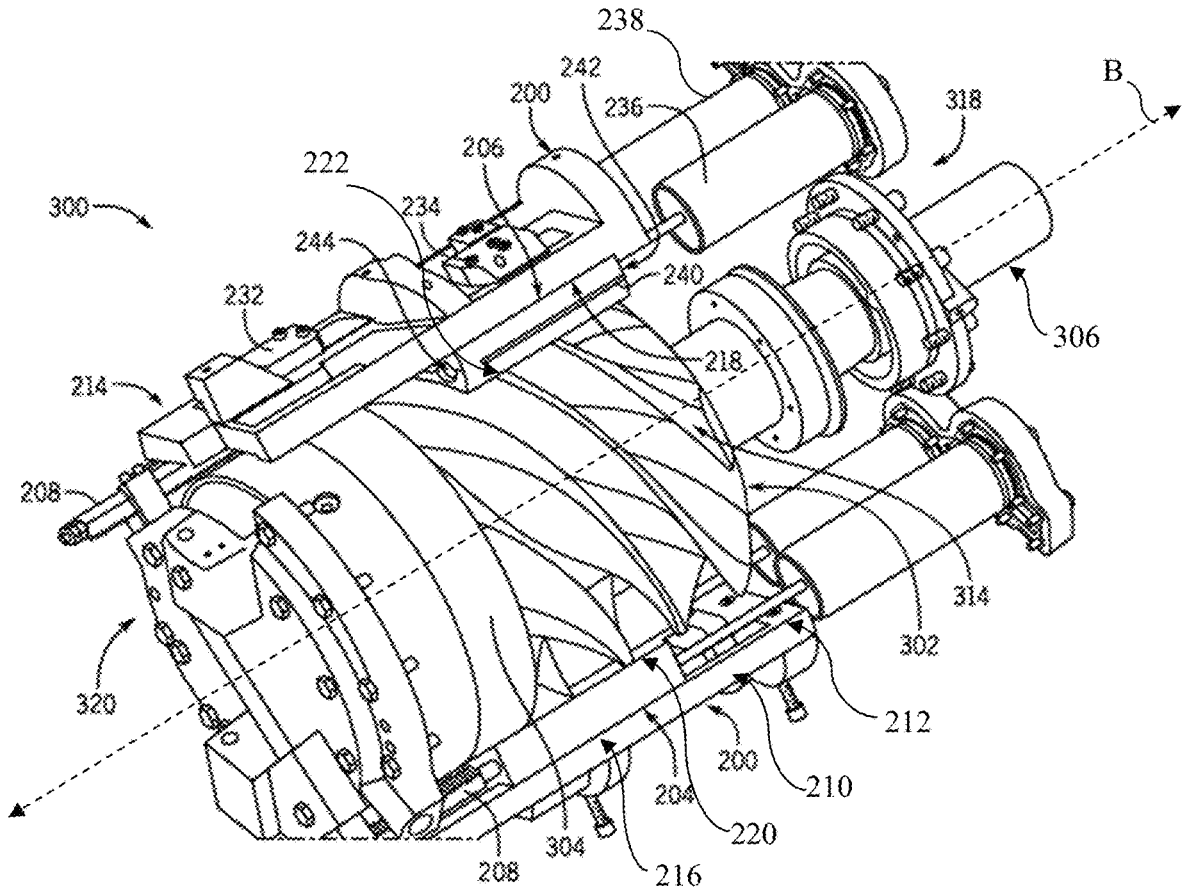
FIG. 5 is a perspective view of a portion of the compressor of FIG. 4, without the housing.

FIGS. 3-5 illustrate of one example of a compressor 300 that includes slide valve assemblies 200 of the present technology. In the example shown in FIGS. 4 and 5, The compressor 300 is a rotary gas compressor for a refrigeration system, and is specifically a single screw rotary gas compressor.

As shown in FIGS. 4 and 5, the compressor 300 has a helically grooved main rotor 302 that has a cylindrical outer surface 304 and a rotor shaft 306. The rotor shaft 306 extends axially along a schematic central axis B. Compressor 300 also includes a compressor housing 308 (FIG. 4), and the main rotor 302 is mounted for rotation about the rotor shaft 306 within the compressor housing 308. A pair of star-shaped gate rotors 310 (FIG. 4), or star rotors, are also mounted for rotation in the compressor housing 308. Each gate rotor 310 has a plurality of gear teeth 312 that are configured to mesh with the helical grooves 314 of the main rotor 302.

Referring to FIG. 4, the compressor housing 308 generally includes a cylindrical bore 316 in which the main rotor is rotatably mounted. The cylindrical bore 316 may be open at its suction end 318 and may be closed at its discharge end 320 by a discharge end wall (not shown). The rotor shaft 306 of the main rotor 302 is rotatably supported at opposite ends on bearing assemblies (not shown) mounted on compressor housing 308. The compressor housing 308 typically includes spaces 322 therein in which the star rotors 310 are rotatably mounted and the gate rotors 310 are located on opposite sides (i.e., 180 degrees apart) of main rotor 302. Each of the gate rotors 310 has a plurality of gear teeth 312 and is provided with a gate rotor shaft 324 which is rotatably supported at opposite ends on the bearing assemblies (not shown) mounted on the compressor housing 308. Each of the gate rotors 310 typically rotate on a schematic axis which is perpendicular to and spaced from the schematic central axis B of main rotor 302 (the axis of rotation of the main rotor 302) and its gear teeth 312 extend through an opening communicating with cylindrical bore 316. During operation, each gear tooth 312 of each of the gate rotors 310 successively engages a groove in main rotor 302 as the latter is rotatably driven by a motor and, in cooperation with the wall of cylindrical bore 316 and specifically its end wall (not shown), defines a gas compression chamber. The housing 308 is provided with a gas suction port 350.

Referring to FIG. 5, compressor 300 includes two dual slide valve assemblies 200, which are generally mounted inside the compressor housing 308 (FIG. 4) and cooperate with the main rotor 302 to control gas flow into and from the compression chambers formed by the helical grooves 314 on the main rotor 302.

As best shown in FIG. 3, although like components are labeled with like reference numbers in FIGS. 4 and 5, a slide valve assembly 200 of the present technology includes a slide valve carriage 202, as well as two movable slide valve members, namely, a capacity slide valve member 204 and a volume slide valve member 206. The capacity slide valve member 204 controls the size of the suction port, thus affecting the capacity of the compressor. The volume slide valve member 206 controls the size and timing of the discharge port, thus affecting the efficiency of compression by controlling the "volume ratio" of the discharge pressure to suction pressure.

In contrast to currently known slide valve assemblies, slide valve assemblies 200 of the present technology include a volume slide valve member 206 that is not driven by a controller. Instead, the volume slide valve member 206 in the slide valve assembly 200 is self-positioning. As used herein, "self-positioning" means that the slide valve member 206 moves solely in response to differences in pressure between forces acting on the slide valve member 206 due to operation of the compressor 300, such as the groove pressure and the discharge pressure. For example, volume slide valve assemblies of the present technology do not include a controller or other position controlling apparatus, connected to the volume slide valve member. The slide valve assemblies of the present technology may also operate without other mechanical driving components associated with the volume slide valve member, such as a rackshaft, as well as an electrical controller and the cables and software related to the controller.

Each of the movable slide valve members, the capacity slide valve member 204 and the volume slide valve member 206, is slidably secured to the slide valve carriage 202, and is slidably movable longitudinally, or axially, with respect to the carriage 202, parallel to the schematic axis of axial movement A. The volume slide valve member 206 and the capacity slide valve member 204 are independently movable. The volume slide valve member 206 is self-positioning, and automatically slidably adjusts its position to control compressor volume ratio and power input to the compressor. The capacity slide valve member 204 is slidably movable by a controller to control compressor capacity. More specifically, the capacity slide valve member 204 is connected to a first rackshaft 208, which is driven by a controller (not shown) to move the capacity slide valve member 204 longitudinally, or axially, with respect to the carriage 202, parallel to the schematic axis of axial movement A, to a desired position. The volume slide valve member 206 is not connected to a rackshaft, and is also not connected to a controller. The position of the volume slide valve member is thus not driven by a controller.

Referring to FIGS. 3 and 5, carriage 202 includes a rectangular plate portion 210 having a front side 212 and a rear side 214 (FIG. 5). The capacity slide valve member 204 has a rear surface 216, which may be flat and smooth. The volume slide valve member 206 has a rear surface 218, which may be flat and smooth, and may include one or more bottom grooves. The capacity slide valve member 204 has a front surface 220 and the volume slide valve member 206 has a front surface 222. Front surfaces 220 and 222 can each be curved or contoured, and can also be smooth or substantially smooth. The capacity slide valve member 204 and the volume slide valve member 206 can also include inside surfaces 224 and 226, respectively, which can each be flat and smooth or substantially smooth. The capacity slide valve member 204 and the volume slide valve member 206 can further include outside surfaces 228 and 230, respectively, which can each be contoured or curved and smooth or substantially smooth. Referring to FIG. 5, the volume slide valve member 206 also has a first end surface 242 that faces the suction end 318 of the compressor 300, and a second end surface 244 that faces the discharge end 320 of the compressor 300. The volume slide valve member 206 can also include a volume low pressure outside groove 240 that can be formed or otherwise created in, and extend across a substantial portion of, or almost the entire extent of, an outside surface of the volume slide valve member 206.

Figure 7:
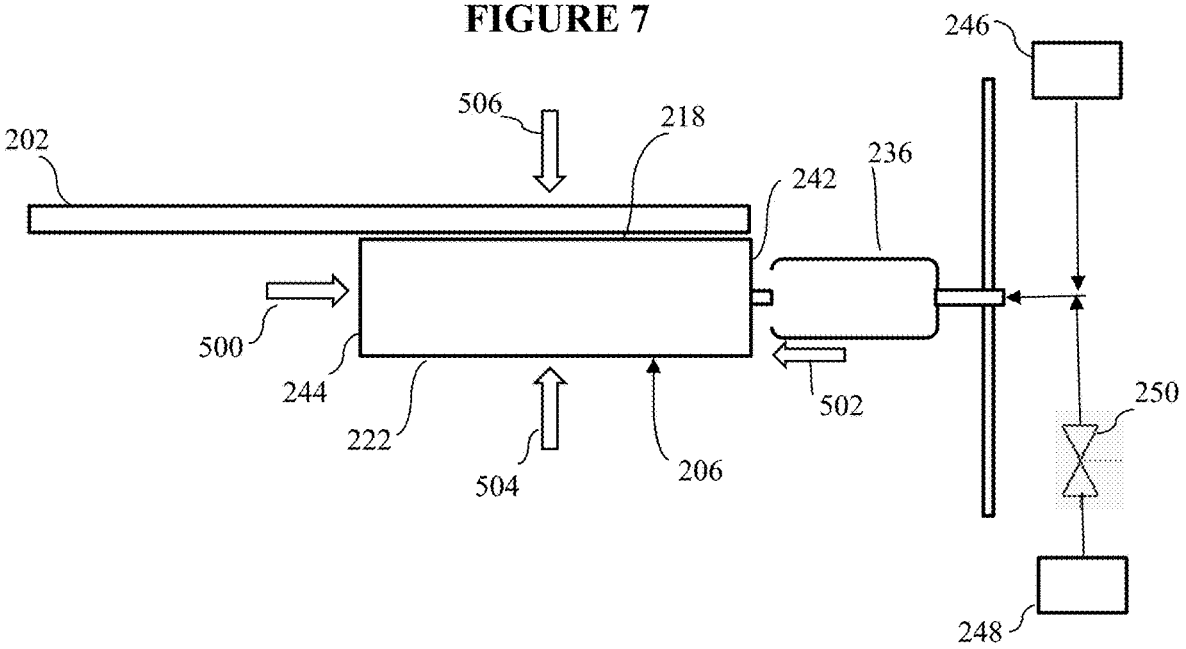
FIG. 7 illustrates a side view of a simplified representation of a volume slide member of the present technology, in a first position, which is an initial position.
Figure 8:
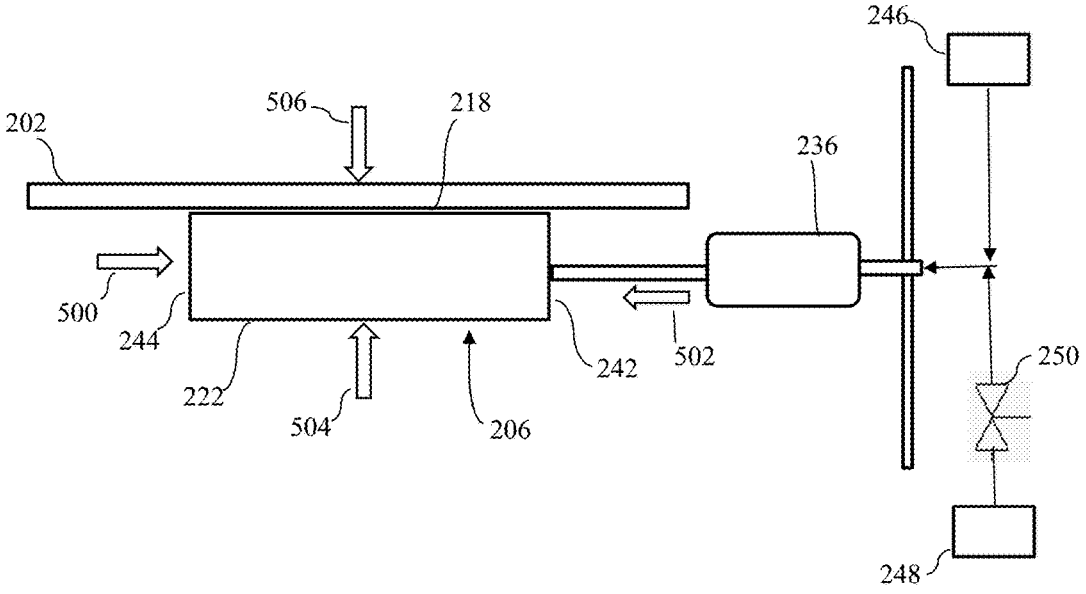
FIG. 8 illustrates the volume slide member of FIG. 7, in a second position, which is a partial capacity position.
Figure 9:
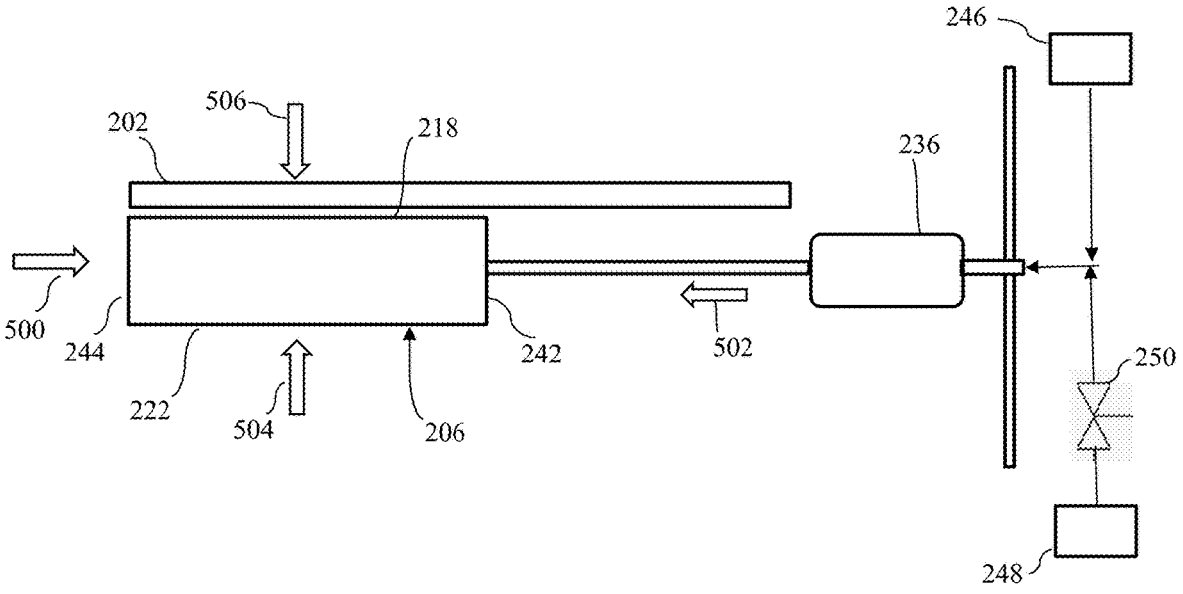
FIG. 9 illustrates the volume slide member of FIG. 7, in a third position, which is a full capacity position.

The rear surface 216 of the capacity slide valve member 204 and the rear surface 218 of the volume slide valve member 206 each face towards and slide upon the front side 212 of the rectangular plate portion 210 of carriage 202. Front surface 220 of the capacity slide valve member 204 and front surface 222 of the volume slide valve member 206 each face towards the cylindrical surface 304 of the main rotor 302 (FIGS. 4 and 5). The inside surface 224 of the capacity slide valve member 204 and the inside surface 226 of the volume slide valve member 206 can slidably engage each other. The outside surface 228 of the capacity slide valve member 204 and the outside surface 230 of the volume slide valve member 206 can face towards and slidably engage a compressor structure, such as an inside wall of cylindrical bore 316 (FIG. 4). The slide valve assembly 200 also includes a volume slide valve balance piston 236, and a capacity slide valve balance piston 238, each of which is connected to the discharge gas 246 (FIGS. 7 through 9). Referring to FIGS. 7 through 9, the volume slide valve balance piston 236 is also connected to the suction gas 248. Referring to FIG. 5, the capacity slide valve member 204 and the volume slide valve member 206 can be slidably secured to carriage 202, such as by capacity clamping member 232 and volume clamping member 234, which may be secured to the slide valve members by fasteners, such as screws or any other suitable type of fastener.

During operation, different portions of the volume slide valve member 206 are in contact with compression gasses at various stages of compression, and the compression gasses at those various stages of compression act on the portion of the volume slide valve member 206 that they contact. Referring to FIG. 5, initial compression gasses at suction pressure enter the main rotor 302 at the suction end 318. As the compression gasses travel through the compression chambers formed by the helical grooves 314, they become intermediate compression gasses, which have an increasing pressure as they travel from the suction end 318 towards the discharge end 320. When the compression gasses exit the helical grooves 314 they are discharge gasses and have a pressure that is discharge pressure. The gasses around the outside of the main rotor 302 and the initial compression gasses are at suction pressure, and therefore exert a force known as "suction pressure" on portions of the volume slide valve member 206. The discharge gasses that are discharged from the helical grooves 314 exert a force known as "discharge pressure" on portions of the volume slide valve member 206. The intermediate compression gasses, which have an increasing pressure as they travel from the suction end 318 towards the discharge end 320 exert a force known as "groove pressure" on portions of the volume slide valve member 206.

The compressor 300 is configured to provide balanced opposing pressures along the schematic axial axis of movement of the volume slide valve member 206, which is parallel to the schematic axis A (FIG. 3) and the schematic axis B of the compressor 300 (FIG. 5). Specifically, referring to FIG. 3, a first discharge pressure force is exerted on the second end surface 244 of the volume slide valve member 206 by the discharge gasses. To balance that first discharge pressure force, the slide valve assembly 200 includes a balance piston 236, which has connection to the discharge gasses (not shown). The balance piston 236 exerts a second discharge pressure force on the first end surface 242 of the volume slide valve member 206, where the second discharge pressure force is equal to the first discharge pressure force since they are derived from the same discharge gasses.

Figure 6:
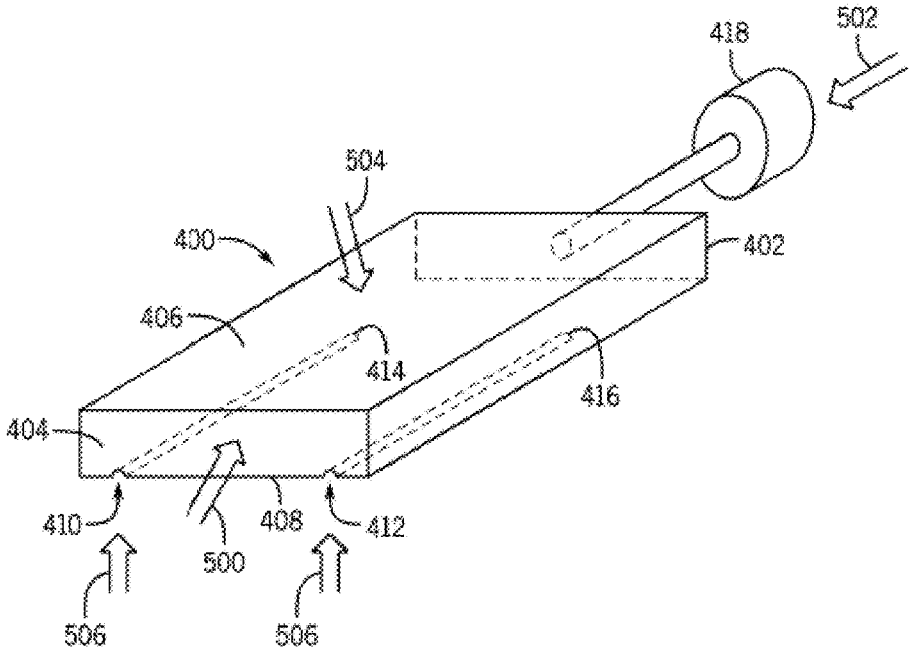
FIG. 6 illustrates perspective view of a simplified representation of a volume slide member of the present technology, and the forces that act on the volume slide member during operation.

An example of the forces acting on the volume slide valve member in a slide valve assembly 200 of the present technology, in both the axial and radial directions, can best be seen in FIG. 6. FIG. 6 illustrates a simplified version of a volume slide valve member 400, with the forces that act on the volume slide during operation. It should be understood that in an actual compressor, the volume slide valve member 400 can have any of the features (e.g., grooves and/or surfaces) of volume slide valve member 206 as described above, and the volume slide valve member 206 can have any of the features (e.g., grooves and/or surfaces) described with respect to volume slide valve member 400.

As shown in FIG. 6, the volume slide valve member 400 has a first end surface 402, a second end surface 404, a front surface 406 and a rear surface 408. The rear surface 408 of the volume slide valve member 400 may have one or more bottom grooves, such as first bottom groove 410 and second bottom groove 412. Each of the bottom grooves may extend along a portion of the length of the rear surface 408 of the volume slide valve member 400, or along the entirety of the length of the rear surface 408 of the volume slide valve member 400. In FIG. 6, the first bottom groove 410 extends along extends along a portion of the length of the rear surface 408 of the volume slide valve member 400 and has a terminal end 414, and second bottom groove 412 extends along a portion of the length of the rear surface 408 of the volume slide valve member 400 and has a terminal end 416.

The compressor (which may be compressor 300) is configured to provide balanced pressures along the axial axis of movement the volume slide valve member 400. Specifically, a first discharge pressure force 500 is exerted on the second end surface 404 of the volume slide valve member 400 by the discharge gasses. To balance that first discharge pressure force, the slide valve assembly includes a balance piston 418, which is connected to the discharge gasses (not shown) and to the suction gasses (not shown). The balance piston 418 exerts a balance piston force 502 on the first end surface 402 of the volume slide valve member 400. The balance piston force 502 during operation of the compressor is a second discharge pressure force that is provided by the connection to the discharge gasses (not shown), and this is equal to the first discharge pressure force 500.

In a radial direction, which is perpendicular to the axial direction, there is a groove pressure force 504 acting on the front surface 406 of the volume slide member 400. There is a countering pressure force 506, which is equal to the discharge pressure and acts within the one or more bottom grooves, which may be first bottom groove 410 and second bottom groove 412.

Since the forces applied to the volume slide member 400 are designed to be balanced when the compressor is operating in a state of ideal compression, a slight change in the groove pressure due to an incorrect volume slide location will induce a different pressure near the second end surface 404, which will create an unbalanced system. In response, the volume slide member 400 will self-position by moving due to the unbalanced forces, until the groove pressure is identical to the discharge pressure, resulting in an ideal position/compression in all cases at any conditions.

FIGS. 7 through 9 illustrate the forces described above with respect to FIG. 6 as applied to the volume slide valve member 206 in a slide valve assembly 200, during operation of a compressor 300 (shown in FIG. 3). FIGS. 7 through 9 illustrate side view of a simplified version of a volume slide valve member 206, the slide valve carriage 202, and the volume slide valve balance piston 236. In each of FIGS. 7 through 9, the volume slide valve balance piston 236 is connected to the discharge gas 246 and is also connected to the suction gas 248 via a suction gas valve 250.

In FIG. 7, the volume slide valve member 206 is in an initial position, which is the desired position during start-up of the compressor. If the length of the slide valve carriage 202 is viewed as a spectrum of the range of motion for the volume slide valve member 206 from right to left, the initial position of the volume slide valve member 206 as shown can be thought of as being a 0% position.

In FIG. 8, the volume slide valve member 206 is in an intermediate position, which is one potential position during operation of the compressor. Although a specific intermediate position is shown, it should be understood that there are a potentially infinite number of intermediate positions, since the volume slide valve member may move to any point between the initial position and the full capacity position shown in FIG. 9, and each such position is an intermediate position.

In FIG. 9, the volume slide valve member 206 is in a full capacity position, or 100% position. The full capacity position shown is one potential position during operation of the compressor, and occurs when the compressor is operating at full capacity.

Referring to FIGS. 8 and 9, during operation of the compressor (which may be compressor 300), a first discharge pressure force 500 is exerted on the second end surface 244 of the volume slide valve member 206 by the discharge gasses. To balance that first discharge pressure force, volume slide valve balance piston 236 exerts a balance piston force 502 on the first end surface 242 of the volume slide valve member 206. Because the balance piston 236 is connected to the discharge gasses 246, the balance piston force 502 is a second discharge pressure force, which is equal to the first discharge pressure force 500.

In a radial direction (up and down as shown in FIGS. 8 and 9), which is perpendicular to the axial direction (left and right as shown in FIGS. 8 and 9), there is a groove pressure 504 acting on the front surface 222 of the volume slide valve member 206, which is generated by the intermediate gasses. There is a countering pressure force 506, which is equal to the discharge pressure and acts on the rear surface 218 of the volume slide valve member 206. The countering pressure force 506 may act within one or more bottom grooves of the volume slide valve member 206 (such as bottom grooves 410 and 412 as shown in FIG. 6).

Since the forces applied to the volume slide valve member 206 are designed to be balanced when the compressor is operating in a state of ideal compression, changes in the groove pressure 504 during operation of the compressor due to an incorrect volume slide location will induce a different pressure near the second end surface 244, which will create an unbalanced system. In response, the volume slide valve member 206 will self-position by moving due to the unbalanced forces, until the groove pressure is identical to the discharge pressure, resulting in reestablishing an ideal position/compression.

During start-up or shutdown of the compressor, it is desired for the volume slide valve member 206 to be in its initial position, as shown in FIG. 7. However, when a compressor transitions from not operating to operating during start-up, or from operating to not operating during shut-down, the forces acting on the volume slide valve member 206 may experience sudden flux. In such situations, the forces acting on the volume slide valve member 206 may not result in the volume slide valve member 206 naturally self-positioning to the initial position without further adjustment of the forces acting on the volume slide valve member 206. That further adjustment is provided by the connection of the balance piston 236 to the suction gasses 248 via suction gas valve 250, as shown in FIGS. 7 through 9.

During normal compressor operation, the suction gas valve 250 is closed, and the balance piston pressure 502 exerted on the volume slide valve member 206 is equal to the discharge pressure, because the connection of the balance piston 236 to the discharge gasses 246 is always open. However, during start-up and shut-down of the compressor, the suction gas valve 250 is opened, which causes the balance piston 236 to exert a balance piston pressure 502 that is the result of the combined discharge gasses 246 and suction gasses 248. Because the suction gasses 248 are at a much lower pressure than the discharge pressure 246, the balance piston force 502 will be lower than the first discharge pressure force 500. When the balance piston force 502 is lower than the first discharge pressure force 500, the volume slide valve member 206 will move to the initial position, as shown in FIG. 7.

The suction gas valve 250 may be any suitable type of valve, such as a high-pressure solenoid valve. The suction gas valve 250 may be operationally connected to a controller (not shown) as needed to control the opening and closing of the suction gas valve 250.

Optionally, the suction gas valve 250 may be opened in other situations where the volume slides get locked in any given position, such as due to some debris or any other issue. Actuating the suction gas valve 250 to open and close in such situations may create an additional axial load on the volume slide valve member 206 and unlock it.

Figure 10:
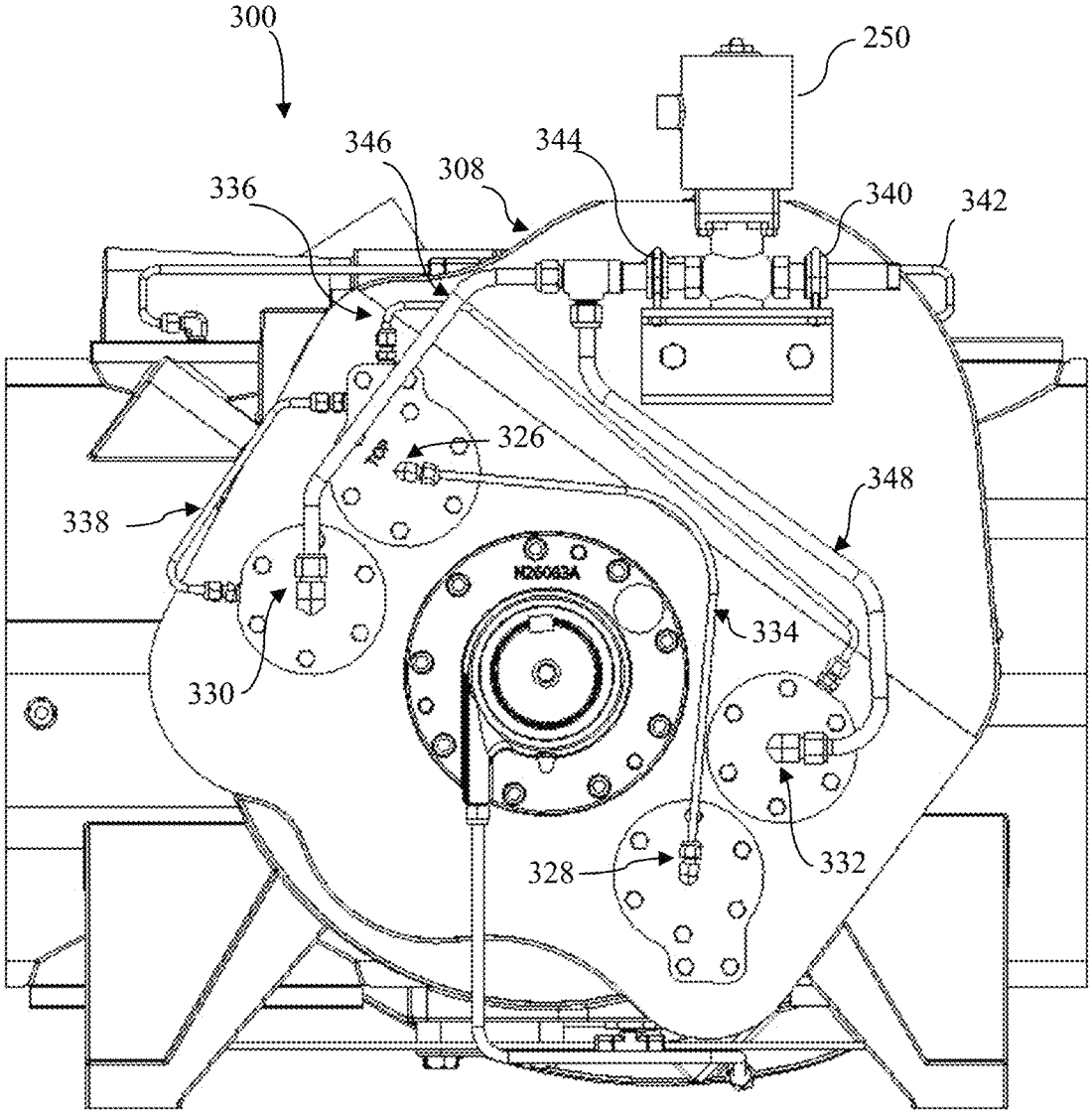
FIG. 10 illustrates an external side view of the drive shaft end of the single screw compressor of FIG. 4.

FIG. 10 illustrates an external side view of the drive shaft end of the single screw compressor of the single screw compressor 300 of the present technology, which shows portions of the compressor housing 308 as well as several connection points at which connections to various components of the compressor 300 can be made. As can be seen in FIG. 5, the compressor 300 includes two slide valve assemblies 200. With reference to FIG. 3, each slide valve assembly 200 includes a capacity slide valve member 204 that is abutted by a capacity slide valve balance piston 238, and a volume slide valve member 206 that is abutted by a volume slide valve balance piston 236. Accordingly, FIG. 10 shows that the compressor 300 includes a first capacity piston connection point 326 at which connections to the first capacity slide valve balance piston can be made, and a second capacity piston connection point 328 at which connections to the second capacity slide valve balance piston can be made. The compressor 300 also includes a first volume piston connection point 330 at which connections to the first volume slide valve balance piston can be made, and a second volume piston connection point 332 at which connections to the second volume slide valve balance piston can be made.

At least one discharge gas connection line 334 is provided that provides discharge gasses to the first capacity slide valve balance piston 238 at the first capacity piston connection point 326, and to the second capacity slide valve balance piston 238 at the a second capacity piston connection point 328.

At least one discharge gas connection line, shown in two parts as first line 336 and second line 338, is provided that provides discharge gasses to the first volume slide valve balance piston 236 at the first volume piston connection point 330, and to the second volume slide valve balance piston 236 at the a second volume piston connection point 332.

The valve 250 is connected on a first side 340 to a suction gas input line 342, and on a second side 344 to a first suction gas output line 346 that provides suction gas to the to the first volume slide valve balance piston 236 at the first volume piston connection point 330, and a second suction gas output line 348 that provides suction gas to the second volume slide valve balance piston 236 at the second volume piston connection point 332.

Figure 11:
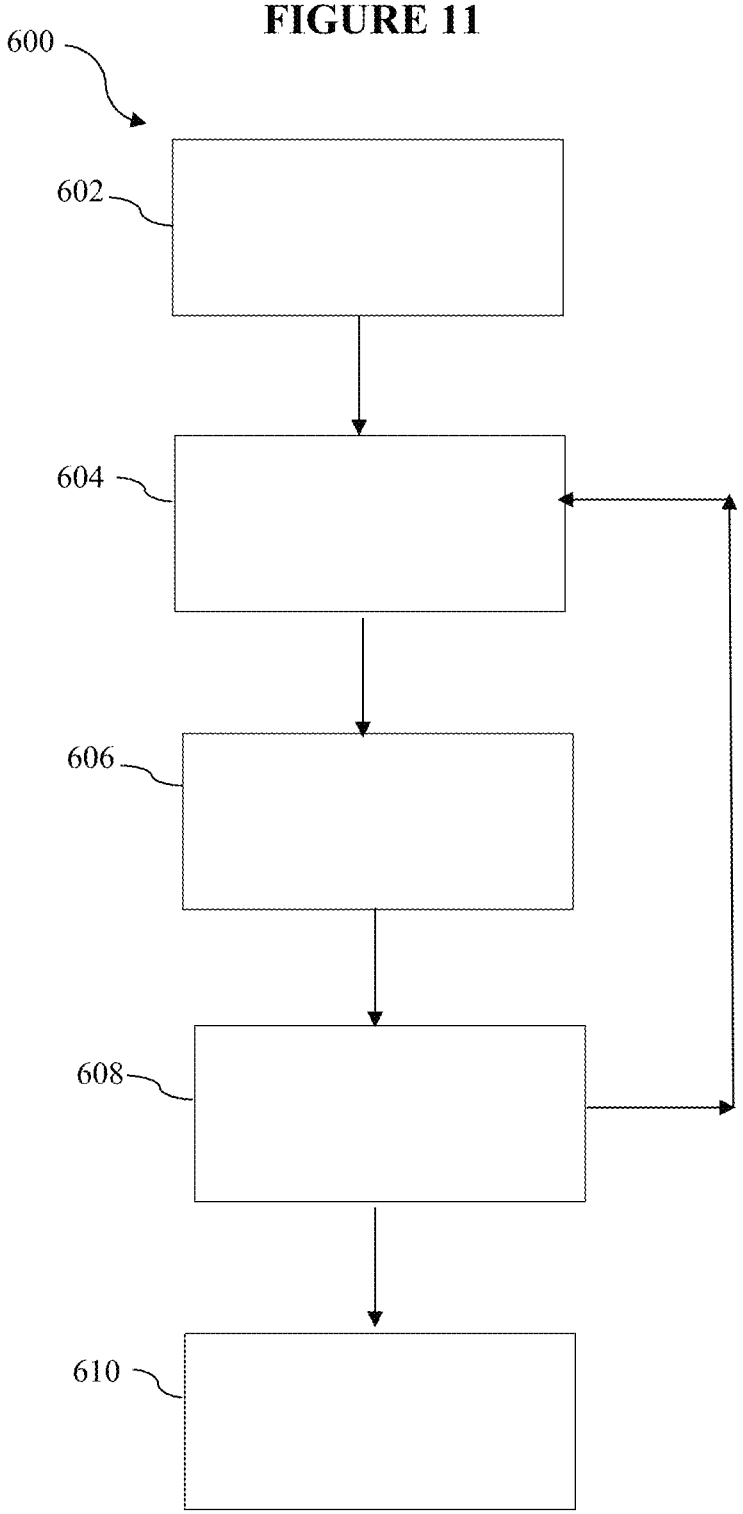
FIG. 11 is a flow diagram of one example of a method of operation of a compressor having a slide valve assembly of the present technology.

FIG. 11 is a flow diagram of one example of a method of operation of a compressor having a slide valve assembly of the present technology, such as slide valve assembly 200 as shown in FIGS. 3-5. The compressor has at least three phases of operation, including start-up, normal operation, and shutdown. The slide valve assembly used in the method includes at least a slide valve carriage, a volume slide valve member secured to the slide valve carriage and slidably movable longitudinally with respect to the slide valve carriage, and a capacity slide valve member secured to the slide valve carriage and slidably movable longitudinally with respect to the slide valve carriage. The capacity slide valve member may be slidably movable longitudinally by a controller, and may be connected to the controller by a rackshaft. The volume slide valve member is be self-positioning longitudinally. There is a volume slide valve balance piston that abuts the first end of the volume slide valve member, the volume slide valve balance piston being connected to discharge gasses of the compressor and by a suction gas valve to suction gasses of the compressor. The volume slide valve member is not connected to a rackshaft or a controller.

The method 600 starts at step 602, which includes operating the compressor in the start-up phase, wherein the suction gas valve is open. Operating the compressor in the start-up phase may include opening the suction gas valve at a start of the start-up phase. The method continues to step 604, which includes operating the compressor in the normal operation phase, wherein the suction gas valve is closed. Operating the compressor in the normal operation phase may include closing the suction gas valve at a start of the normal operation phase.

The method continues to step 606, which includes adjusting the position of the slide valve member by self-positioning of the slide valve member in response to unbalanced forces during the normal operation phase. Unbalanced forces that occur during the normal operation phase and act upon the volume slide member may be due to a difference between the discharge pressure and the groove pressure. In some examples of such circumstances, the discharge pressure may be greater than the groove pressure. In other examples of such circumstances, the discharge pressure may be less than the groove pressure. The slide valve member self-positions by adjusting its position until the groove pressure equals the discharge pressure. In methods of the present technology, there is not a controller or other position controlling apparatus connected to slide valve member that moves the controller. Instead, the slide valve member moves solely in response to differences in pressure between the groove pressure and the discharge pressure. When the compressor is operating in under compression, where the discharge pressure is greater than the groove pressure, then the slide valve member may adjust its position by self-positioning in a first direction. When the compressor is operating in over compression, where the discharge pressure is less than the groove pressure, then the slide valve member may adjust its position by self-positioning in a second direction longitudinally opposite of the first direction.

Once the slide valve member self-positions by adjusting its position until the groove pressure equals the discharge pressure, the method next continues to step 608, which includes operating the compressor in the normal operation phase under balanced conditions where there are balanced forces acting upon the volume slide member. As the compressor continues to operate, other operation conditions may occur that cause the forces acting upon the volume slide member to once again become unbalanced, and the method may go back to step 604.

The method may further include step 610, which includes operating the compressor in the shutdown phase, wherein the suction gas valve is open. Operating the compressor in the shutdown phase may include opening the suction gas valve at a start of the shutdown phase.

From the foregoing, it will be appreciated that although specific examples have been described herein for purposes of illustration, various modifications can be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A compressor including a slide valve assembly, the compressor having at least three phases of operation, including start-up, normal operation, and shutdown, the compressor comprising:

a slide valve carriage;

a volume slide valve member secured to the slide valve carriage and slidably movable longitudinally with respect to the slide valve carriage, the volume slide valve member having a first end and a second end, wherein the slide valve assembly does not include a rackshaft connected to the volume slide valve member, and the volume slide valve member is self-positioning longitudinally with respect to the slide valve carriage based on a plurality of pressure forces exerted on the slide valve member;

a capacity slide valve member secured to the slide valve carriage and slidably movable longitudinally with respect to the slide valve carriage; and a volume slide valve balance piston that abuts the first end of the volume slide valve member, the volume slide valve balance piston being connected to discharge gasses of the compressor and by a suction gas valve to suction gasses of the compressor;

wherein the suction gas valve is closed during normal operation.

2. The compressor of claim 1, wherein the suction gas valve is open during start-up.

3. The compressor of claim 1, wherein the suction gas valve is open during shutdown.

4. The compressor of claim 1, wherein the volume slide valve balance piston exerts a balance piston pressure force on the first side of the volume slide valve member that is equal to a discharge pressure force when the suction gas valve is closed, and a balance piston pressure force that is the result of a combined pressure of the discharge gasses and the suction gasses when the suction gas valve is open.

5. The compressor of claim 1, wherein the compressor is a rotary gas compressor, and the compressor further comprises a helically grooved main rotor having a schematic rotor axis, and the main rotor is mounted for rotation about the schematic rotor axis.

6. The compressor of claim 1, further comprising a rackshaft connected to the capacity slide valve member.

7. The compressor of claim 1, wherein the slide valve assembly does not include a controller connected to the volume slide valve member to cause movement of the volume slide valve member during normal operation of the compressor.

8. A compressor including a slide valve assembly, the compressor having at least three phases of operation, including start-up, normal operation, and shutdown, the compressor comprising:

a slide valve carriage;

a volume slide valve member secured to the slide valve carriage and slidably movable longitudinally with respect to the slide valve carriage, the volume slide valve member having a first end and a second end, wherein the slide valve assembly does not include a controller connected to the volume slide valve member to cause movement of the volume slide valve member during normal operation of the compressor, and the volume slide valve member is self-positioning longitudinally with respect to the slide valve carriage based on a plurality of pressure forces exerted on the slide valve member;

a capacity slide valve member secured to the slide valve carriage and slidably movable longitudinally with respect to the slide valve carriage; and a volume slide valve balance piston that abuts the first end of the volume slide valve member, the volume slide valve balance piston being connected to discharge gasses of the compressor and by a suction gas valve to suction gasses of the compressor;

wherein the suction gas valve is closed during normal operation.

9. The compressor of claim 8, wherein the suction gas valve is open during start-up.

10. The compressor of claim 8, wherein the suction gas valve is open during shutdown.

11. The compressor of claim 8, wherein the volume slide valve balance piston exerts a balance piston pressure force on the first side of the volume slide valve member that is equal to a discharge pressure force when the suction gas valve is closed, and a balance piston pressure force that is the result of a combined pressure of the discharge gasses and the suction gasses when the suction gas valve is open.

12. The compressor of claim 8, wherein the compressor is a rotary gas compressor, and the compressor further comprises a helically grooved main rotor having a schematic rotor axis, and the main rotor is mounted for rotation about the schematic rotor axis.

13. The compressor of claim 8, further comprising a rackshaft connected to the capacity slide valve member.

14. The compressor of claim 8, wherein the slide valve assembly does not include a rackshaft connected to the volume slide valve member.

15. A method of operating a compressor having a slide valve assembly, wherein the compressor has at least three phases of operation, including start-up, normal operation, and shutdown, and the slide valve assembly includes: a slide valve carriage; a volume slide valve member secured to the slide valve carriage and slidably movable longitudinally with respect to the slide valve carriage, the volume slide valve member being self-positioning along the axis of movement; a capacity slide valve member secured to the slide valve carriage and slidably movable longitudinally with respect to the slide valve carriage, the capacity slide valve member being slidably movable by a controller to control compressor capacity; and a volume slide valve balance piston that abuts the first end of the volume slide valve member, the volume slide valve balance piston being connected to discharge gasses of the compressor and by a suction gas valve to suction gasses of the compressor; the method comprising:

operating the compressor in the start-up phase, wherein the suction gas valve is open;

operating the compressor in the normal operation phase, wherein the suction gas valve is closed;

adjusting the position of the slide valve member by self-positioning of the slide valve member in response to unbalanced forces during the normal operation phase; and operating the compressor in the normal operation phase under balanced conditions where there are balanced forces acting upon the volume slide member.

16. The method of claim 15, further comprising:

operating the compressor in the shutdown phase, wherein the suction gas valve is open.

17. The method of claim 15, wherein the unbalanced forces acting upon the volume slide member include a difference between a discharge pressure and a groove pressure.

18. The method of claim 17, wherein self-positioning of the slide valve member includes the slide valve member adjusting its position until the groove pressure equals the discharge pressure.

* * * * *